US006341453B1

(12) United States Patent
Cholley

(10) Patent No.: US 6,341,453 B1
(45) Date of Patent: Jan. 29, 2002

(54) METHOD FOR PROPPING A STRUCTURE WITH VERTICAL WALLS BY MEANS OF REINFORCEMENT PILLARS, AND PILLAR FOR THIS PURPOSE

(75) Inventor: André Cholley, Seppois le Bas (FR)

(73) Assignee: Piscines Waterair, Seppois-le-Bas (FR)

( * ) Notice: Subject to any disclaimer, the term of this patent is extended or adjusted under 35 U.S.C. 154(b) by 0 days.

(21) Appl. No.: 09/504,142

(22) Filed: Feb. 15, 2000

(30) Foreign Application Priority Data

Feb. 15, 1999 (FR) ..... 99 01900

(51) Int. Cl.[7] ..... E04G 13/02

(52) U.S. Cl. ..... 52/169.1; 264/40; 249/48

(58) Field of Search ..... 52/742.13, 742.14, 52/742.15, 742.1, 745.17, 745.8; 249/48, 49, 51; 264/32

(56) References Cited

U.S. PATENT DOCUMENTS 1,085,713 A * 2/1914 Waldman
1,120,570 A * 12/1914 Venable
1,170,049 A * 2/1916 Cunningham
3,956,437 A * 5/1976 Ellis ..... 264/40
4,749,165 A * 6/1988 Moraca ..... 249/48

* cited by examiner

*Primary Examiner*—Beth A. Stephan
*Assistant Examiner*—Steve Varner
(74) *Attorney, Agent, or Firm*—Abelman, Frayme & Schwab

(57) ABSTRACT

A reinforcement pillar for propping a structure with vertical walls, which includes an envelope with a cylindrical shape, formed from a flat flexible panel with a rectangular shape, including apertures in the vertical walls for securing to the vertical walls, the vertical free edges of the flexible panel being designed to be secured to one another and folded into a cylindrical shape and secured to one another, the envelope being retained relative to the wall by a split hollow tube which stabilizes the envelope

29 Claims, 4 Drawing Sheets

METHOD FOR PROPPING A STRUCTURE WITH VERTICAL WALLS BY MEANS OF REINFORCEMENT PILLARS, AND PILLAR FOR THIS PURPOSE

The present invention relates to a method for propping structures with vertical walls, consisting of pre-fabricated boards which are disposed end to end. More specifically, it relates to propping by means of reinforcement pillars, which in particular assist vertical retention of the said walls, and anchorage of the latter on the ground. The invention also relates to the actual reinforcement pillars.

Pillars of this type, or more generally struts, have been used very commonly for a considerable period of time, in order to prop all kinds of vertical walls, since in many structures, final usage of the walls requires reinforcement of one of the sides of the wall, in order to balance correctly the forces which are present during normal use of the structure.

There therefore exist many possible configurations of struts, ranging from a simple inclined prop, to an X-shaped cross stay, and props which are reinforced by horizontal beams or by heavier buttresses. In fact, to a large extent, the shape, securing to the ground, material etc of the struts depends on their subsequent use, and on the associated stresses (nature of the ground, functions to be provided etc).

In particular, the anchorage to the ground can assume several distinct forms, i.e. it can consist of anchorage piles which are driven into the ground, by casting a body of concrete at the joining point with the ground etc. In some cases, the strut can even comprise a casing for casting concrete, which, after it has solidified, is an integral part of the structure itself of the said strut.

The technical possibilities are therefore many and varied. In the preferred example which will be used within the context of this description, i.e. the construction of pools in particular for swimming pools, it is apparent that the cross stays have firstly the function of preserving the verticality of the walls, despite the enormous pressure which is exerted by the water when the pool is filled.

The swimming pools in question are generally constructed by means of boards with an equivalent surface area, which are juxtaposed and secured to one another for example by being bolted, and are strengthened by means of reinforcement pillars which are often locked in their lower part by concrete bodies.

It will be appreciated that the struts are produced in a factory or workshop, then transported to the site for construction of the wall to be propped, for example at the location of a swimming pool to be built. As a result of their often complex shape, these struts are generally costly to produce and transport. In addition, the hollow or recessed parts which they have in most cases give rise to wasted space when they are transferred to the construction site, which contributes towards adding to the financial burden attributed to the transport.

In the conventional configurations, when the struts are installed, and in order to strengthen the structure satisfactorily, it is often desirable to install armouring which constitutes the framework of an upper peripheral strengthening anchorage unit. In fact, the struts which are usually used rarely have an upper part which can support the said peripheral anchorage unit. However, installation of armouring of this type is a complicated operation, which requires know-how and technical skill which can often only be carried out by professionals, and, which, it will be appreciated, is in general carried out in addition to installation of the props.

By means of the solution proposed according to the invention, the above-described problems and disadvantages are solved, or at least are significantly reduced. In fact, the objectives pursued in creation of the invention were firstly to simplify as far as possible the implementation of the method and production of its components, and secondly to reduce the costs systematically in all the stages.

Firstly, the invention relates to a method for propping a structure with vertical walls by means of reinforcement pillars, characterised in that it comprises the following steps;

- securing flexible flat panels with a rectangular shape to the structure with vertical walls;
- folding each flexible panel into an envelope with a cylindrical shape, and assembly of one of its two free ends to the other, by means of securing units;
- assembly of means which make it possible to assure the stability of the said envelope;
- checking the alignment and perpendicularity of the structure; and
- filling with concrete each volume which has a cylindrical shape.

According to one possibility, assembly of the means for assuring the stability of the reinforcement pillar consists of putting into place at least two units to keep the wall perpendicular, by keeping a hollow tube which is split along its entire length secured onto the envelope, by sliding the units for securing of the free ends of the envelope inside the tube, as well as the said free edges which are drawn together inside the split in the tube.

Then, if necessary, the split tubes are driven in and/or levelled by being cut, such that their free end is at the level of the upper edge of the structure.

It will be noted immediately that the reinforcement pillars used by the method according to the invention require mainly only the following components:

- a flexible flat panel with a rectangular shape;
- retention units;
- a hollow tube which is split along its entire length, and
- concrete.

These components, the shape of which will be analysed in greater detail hereinafter, are generally flat, tubular, or, in the case of the concrete, derived from raw materials which can easily be transported (cement, sand), or are available on the site (water). Consequently, it is possible to optimise transport such as to reduce its cost as far as possible.

The production itself of these components is not costly, since machining of the flat panels is simple and reduced, and the tubes can easily be cut to the required length.

Finally, construction on the site does not cause any particular technical problems, and does not require any specialised know-how.

The invention thus proposes a method which is easy to implement, and is based on elements which are simple to produce and transport.

According to the invention, the structure with vertical walls can consist of pre-fabricated boards disposed end to end, which are erected by securing the superimposed vertical edges of the adjacent boards. The flat panels are then preferably secured at the joining point between each pair of adjacent boards.

The said securing of the flexible panels then completes the securing of the superimposed vertical edges of the adjacent boards in their area of overlapping, with initial partial securing of the boards taking place outside the said area, during erection of the structure.

Preferably, securing of the superimposed edges of the adjacent boards, and of the flexible panels to the said boards, takes place by means of bolting.

In fact, the flexible panels are secured to the structure with a vertical wall along a vertical line.

According to one possibility, each flexible panel is secured to the structure by means of bolts which are aligned at regular intervals, centrally relative to the said panel, with bolting also, as already stated, of the superimposed areas of the adjacent boards onto which the said flexible panel is secured.

This is the reason why it is sufficient initially to bolt onto the boards the ends of the superimposed areas which are not covered by the said panel.

According to one possible configuration, the units for keeping the wall perpendicular are tie bars formed from a straight rod which ends in a hook with a circular shape, and can contain the split tube.

This is another element which is very easy to produce, which has reduced dimensions, and is thus easy to transport.

In order to facilitate the assembly further, each retention tie bar is secured on the vertical securing line of the flexible panels to the boards which form the structure, in the vicinity of the said panel, and directly onto the board. It is for example secured to a threaded rod by means of a nut which is incorporated onto the said threaded rod and the threaded end of the said tie bar. When securing takes place on the wall, at the level of the joining point between each pair of adjacent boards, it is carried out more specifically at the threaded rod of a bolt for assembly of the superimposed areas of adjacent panels, by means of the said nut which is thus incorporated onto the threaded rod and the threaded end of the said tie bar.

Preferably, the units for securing the two free edges of each flexible panel during the folding step consist of bolts.

Mention has previously been made of the problem of the installation, which is difficult to carry out, of the armouring which is designed to support the peripheral anchorage unit. For this purpose, the envelope which is formed by the folded flexible panel contains an armouring reinforcement which permits connection with a high anchorage unit and/or a low anchorage unit.

According to one possibility, the said reinforcement consists of two metal rods, which are disposed in the vicinity of the envelope formed by the flexible panel, and can be folded along the panels in order to form an anchorage unit.

According to another possibility, use can be made of an iron in the shape of a "U", or any complex armouring structure which is easy to instal before folding takes place of the flexible panel which forms the envelope.

In general, the components of the invention can be replaced by conventional technical equivalents, and it is apparent that the materials are selected according to the technical stresses specific to each site.

Thus, according to one possibility, the flexible panels are metal panels.

However, if other materials are suitable, in particular owing to their flexibility, strength, or capacity to resist wet or dry ground etc, they can of course also be used.

The invention which is the subject of the present text also relates to the reinforcement pillars used in the above-described method.

The latter, when used in an equivalent context, are characterised in that they comprise an envelope with a cylindrical shape, formed from a flat panel with a rectangular shape, comprising means for securing to the said vertical boards, the vertical edges of the said panel being folded into a cylinder and secured to one another by means of securing units, the envelope being retained relative to the wall by means for assuring the vertical position of the envelopes.

More specifically, the said means for assuring the vertical position consist of a hollow tube which is split along its entire length, and accommodates the securing units, as well as the free edges of each flexible panel, and co-operates with means for retention which connect the said tube to the wall.

These characteristics make the reinforcement pillars according to the invention totally compatible with the method previously explained.

For this purpose, according to a preferential configuration, the means for securing to the vertical panels are apertures which are aligned parallel to the edges which are designed to be secured to one another.

Also preferably, the apertures are aligned centrally relative to the edges of the flexible panels which are designed to be secured to one another.

As previously stated, the apertures can correspond to those which are provided in the vertical edges of the boards of the structure (with the same spacing), and thus co-operate with the same securing bolts.

The units for securing the free edges of the flexible panels, the retention means in the form of a tie bar, and the reinforcement or rods which are designed for armouring of the framework of the upper anchorage unit, are an integral part of the reinforcement pillars, and are identical to the means used within the context of the method. However, in order to establish the armouring, the said rods have a length which is much longer than the envelope. They are thus incorporated in the high and/or low reinforced concrete anchorage unit.

From the point of view both of the method and the device, this invention is in particular, and more specifically, designed to be applied to the construction of swimming pools. It will be appreciated that it can also be applied to other technical fields, provided that the conditions of application are those which have been defined, i.e. vertical walls consisting of mounted-on pre-fabricated panels, etc.

It simplifies most of the construction operations by means of its new, particularly discerningly designed reinforcement pillar, which needs only elementary components, produced with a minimum of machining operations, and of which the final configurations before assembly are easy to transport.

The cost reductions which are permitted by the invention are thus derived both from production of the initial components, and from transport or construction on the site.

These advantages are determining factors in comparison with the methods and systems known hitherto, which are far more costly and difficult to implement.

The invention will now be described in greater detail with reference to the attached figures, in which:

FIG. 1 is a perspective view of a structure applied to the construction of the pool of a swimming pool;

FIGS. 2*a* to 2*c* show the steps of production of the is casings of the reinforcement pillars according to the invention;

In the various figures which will now be described in detail, the references allocated to the components or to certain details are repeated from one figure to another.

Figure 1:
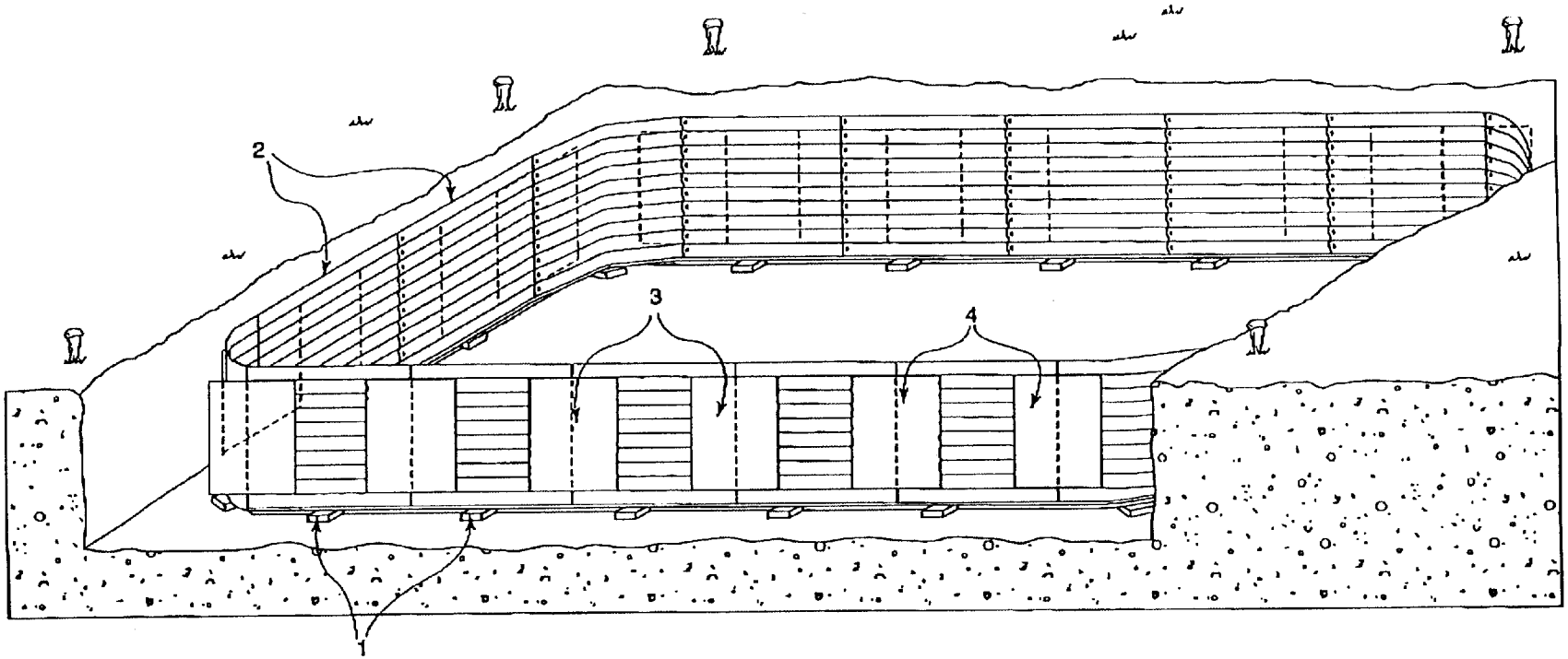

In FIG. 1, the structure with vertical walls is installed on small slabs 1 which are disposed on the layout selected for the pool, in an excavation which is designed to contain the swimming pool. This structure consists of identical pre-fabricated panels 2, which are secured to one another end to end, the ends of two adjacent panels being bolted along a vertical superimposition area.

The flexible panels 3 are centred at the level of the bolting areas, and are provided with apertures which are at the same spatial intervals as the apertures provided in the vertical lateral edges of the boards 1. The references 4 show these securing bolts accommodated in the aforementioned apertures.

Before the flexible panels 3 are fitted, fine structural boards 2 are secured to one another by means of the two bolts at the upper and lower ends, the securing being completed when the said flexible panels 3 are attached.

Figures 2A, 2B, 2C:
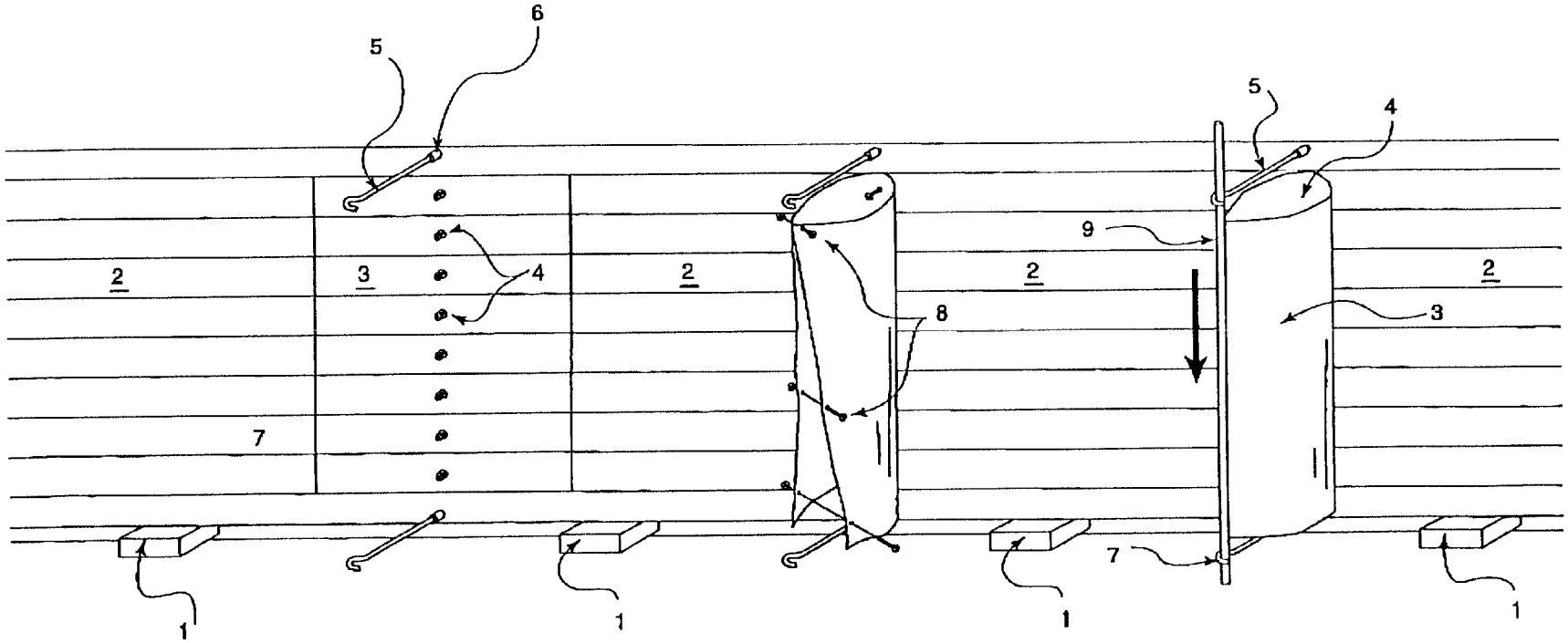

FIGS. 2*a* to 2*c* show in greater detail production of the casing for the reinforcement pillars. Firstly (FIG. 2*a*), there is securing of the retention tie bars 5, the threaded end of which, which has the same diameter as the screw of the bolt 4, is connected to the latter by means of a joining nut 6. There are two of these tie bars 5, with an end in the shape of a hook 7 which is disposed on both sides of the flexible panel 3.

With reference to FIG. 2*b,* the free ends of each panel 3 are folded and attached to one another by bolts 8. A tube 9 which is split along its entire length is then inserted onto the two secured ends of the flexible panel 3, such that the securing means 8 are inside the said tube.

The vertical arrow indicates the direction of sliding of the tube 9, and the direction of driving into the ground on which the reinforcement pillar is supported. Within the context of the method, the tube 9 is either driven in, or is cut such that its upper end is at the level of the upper horizontal edge of the boards 2 of the structure.

Figure 3:
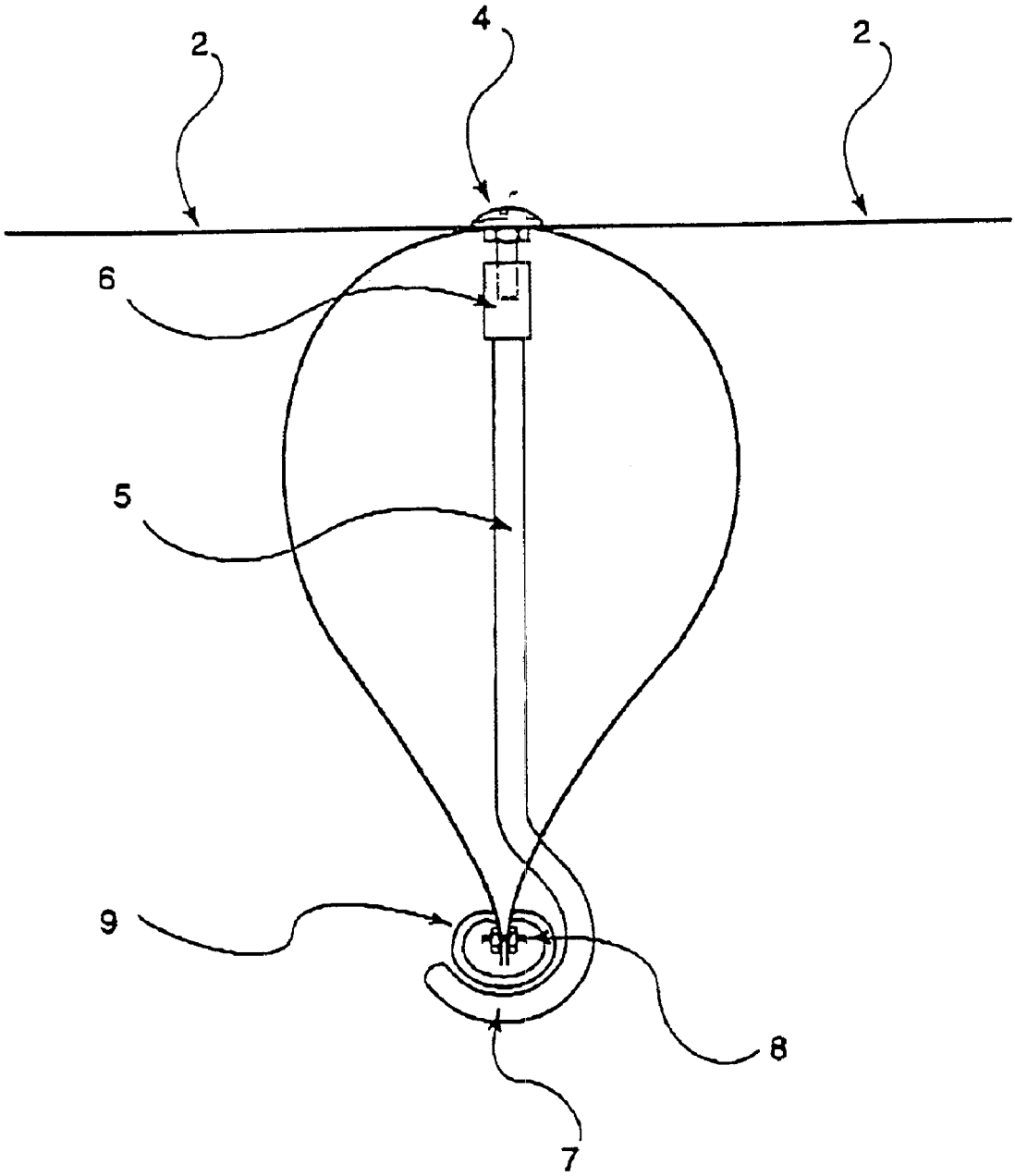
FIG. 3 is a plan view of a reinforcement pillar.

FIG. 3 provides another view of the aforementioned mechanical connections. The retention tie bar 5 is secured perpendicularly relative to the board 2 by the nut 6, which is screwed directly onto the screw of the bolt 4 which secures the adjacent boards 2, on both sides of the flexible panel 3. The hook 7 has a circular shape, which is designed for retention of the split tube 9. The split 10, which is provided along the entire length of the said tube 9, such that sliding can take place, permits passage of the edges which have been drawn together of the flexible panel 3. In fact, the securing bolts 8 lock these edges into the tube 9.

Figure 4:
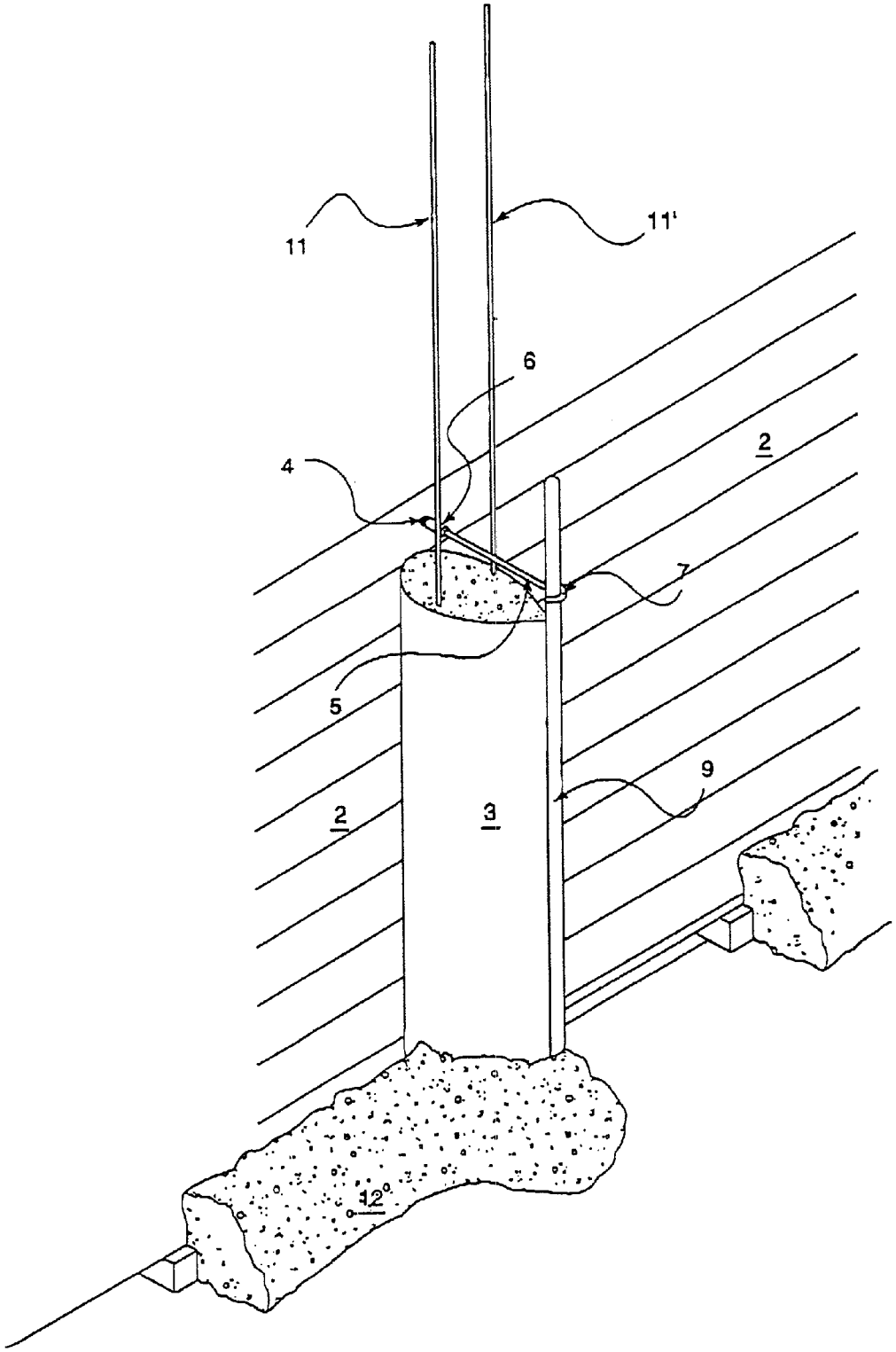
FIG. 4 is a perspective view showing the last steps of the method, for the purpose of completion of the reinforcement pillars according to the invention.

FIG. 4 shows the final step of the method, which is also the last step of construction of a reinforcement pillar according to the present invention. In comparison with the configuration shown in FIG. 2*c,* two rods 11,11' with a long length have been added in the interior of the casing.

Concrete is then poured into the said casing, until by the cylindrical volume is filled. It should be noted that in the absence of a base, the said concrete overflows at the base of the casing, thus initiating a concrete rim 12 which acts as a low anchorage unit (which may or may not be reinforced), running along the entire lower periphery of the structure with vertical walls. The actual reinforcement pillar is thus mechanically connected in an extremely simple manner to the lower strengthening system (rim).

The rods (11,11') constitute the upper armouring; they can be folded towards the adjacent reinforcement pillars in order to constitute the reinforcement of the upper strengthening system. In fact they form the armouring which constitutes the framework of the upper peripheral anchorage unit.

The preceding description relates to an example which cannot be considering to be limiting in relation to the invention. On the contrary, the latter incorporates all the variants of shape, materials and techniques which are included within the field which is protected by the attached claims.

What is claimed is:

1. A method for propping a structure with vertical walls by means of reinforcement pillars, which comprises the following steps:

a) securing flexible flat panels with a rectangular shape to the structure with vertical walls;

b) folding each flexible panel into an envelope with a cylindrical shape, and assembling one of the two free ends of the said panel to the other, by means of securing units;

c) checking the alignment and perpendicularity of the structure; and d) filling with concrete each volume delimited by the cylindrical shape of said envelope.

2. The method according to claim 1 for propping by means of reinforcement pillars, wherein the method comprises means for stabilizing said envelope.

3. Method according to claim 2, for propping by means of reinforcement pillars, characterised in that assembly of the means for assuring the stability of the reinforcement pillar consists of putting into place at least two units to keep the wall perpendicular, by keeping a hollow tube which is split along its entire length secured onto the envelope, by sliding the units for securing of the free ends of the envelope inside the tube, as well as the said free edges which are drawn together inside the split in the tube.

4. The method according to claim 3 for propping by means of reinforcement pillars, wherein the split tubes are driven in until their free end is at the level of the upper edge of the structure.

5. The method according to claim 3 for propping by means of reinforcement pillars, wherein the split tubes are levelled by being cut, whereby their free end is at the level of the upper edge of the structure.

6. Method according to claim 3, for propping by means of reinforcement pillars, characterised in that the units for keeping the wall perpendicular are tie bars formed from a straight rod which ends in a hook with a circular shape, and can contain the split tube.

7. The method according to claim 6 for propping by means of reinforcement pillars, wherein each tie bar is secured on the vertical securing line of the flexible panels to the boards which form the structure, in the vicinity of said panel, and directly onto the board.

8. Method according to claim 7, for propping by means of reinforcement pillars, characterised in that each retention tie bar is secured to a threaded rod by means of a nut which is incorporated onto the said threaded rod and the threaded end of the said tie bar.

9. The method according to claim 1 for propping by means of reinforcement pillars, wherein the structure with vertical walls consists of pre-fabricated boards disposed end-to-end, which are erected by securing the vertical edges of the adjacent boards along an area of overlapping.

10. The method according to claim 9 for propping by means of reinforcement pillars, wherein the flexible panels are then secured at the said area of overlapping between each pair of boards secured to one another end-to-end, thus completing the securing of the superimposed vertical edges of the adjacent boards in their area of overlapping, with initial partial securing of the boards taking place outside said area, during erection of the structure.

11. The method according to claim 10 propping by means of reinforcement pillars, wherein the securing of the superimposed edges of the boards secured to one another end-to-end, and of the flexible panels to said boards, takes place by means of bolting.

12. A method according to claim 1 for use in the construction of a pool.

13. A method according to claim 12 for use in construction of a swimming pool.

14. Method according to claim 1, for propping by means of reinforcement pillars, characterised in that the flexible panels are secured to the structure with a vertical wall along a vertical line.

15. Method according to claim 14, for propping by means of reinforcement pillars, characterised in that the said vertical line is disposed centrally relative to the free edges to be assembled.

16. Method according to claim 1, for propping by means of reinforcement pillars, characterised in that the flexible panels are metal panels.

17. Method according to claim 1, for propping by means of reinforcement pillars, characterised in that the said reinforcement consists of two metal rods, which are disposed in the vicinity of the envelope formed by the flexible panel, and can be folded along the panels in order to form an anchorage unit.

18. The method according to claim 1 for propping by means of reinforcement pillars, wherein the units for securing said two free ends of each flexible panel during the folding step consist of bolts.

19. The method according to claim 1 for propping by means of reinforcement pillars, wherein the envelope which is formed by the folded flexible panel contains an armouring reinforcement which permits connection with a high anchorage unit.

20. The method according to claim 1 for propping by means of reinforcement pillars, wherein the envelope which is formed by the folded flexible panel contains an armouring reinforcement which permits connection with a low anchorage unit.

21. A reinforcement pillar for propping a structure with vertical walls, which comprises an envelope with a cylindrical shape, formed from a flat flexible panel with a rectangular shape, comprising means for securing to said vertical walls, the vertical free edges of said panel being folded into a cylinder and secured to one another by means of securing means, the envelope being retained relative to the wall by means for stabilizing the envelope.

22. The reinforcement pillar according to claim 21 for propping a structure, wherein said means for stabilizing the envelope include a hollow tube which is split along its entire length, and accommodates said securing means, as well as the free edges of each flexible panel, and co-operates with retention means which connect said tube to the wall.

23. Reinforcement pillar according to claim 22, for propping a structure, characterised in that the means for retention consist of a straight-rod tie bar which ends in a hook with a circular shape, which surrounds the split tube, and the other end of which is secured perpendicular to the vertical wall.

24. The reinforcement pillar according to claim 21 for propping a structure, wherein the means for securing to the vertical walls are apertures which are aligned parallel to the edges of the flexible panel which are adapted to be secured to one another.

25. The reinforcement pillar according to claim 24 for propping a structure, wherein said apertures are aligned centrally relative to said free ends of the flexible panel which are designed to be secured to one another.

26. Reinforcement pillar according to claim 21, for propping a structure, characterised in that the envelope with a cylindrical shape contains an armouring reinforcement which permits connection with a high anchorage unit and/or a low anchorage unit.

27. The reinforcement pillar according to claim 21 for propping a structure wherein the securing means are bolts.

28. Reinforcement pillar according to claim 21 for propping a structure, characterised in that the structure with vertical walls consists of pre-fabricated boards disposed end to end.

29. Reinforcement pillar according to claim 25 for propping a structure, characterised in that the armouring reinforcement consists of two metal rods, which can be folded along the panels in order to form an anchorage unit.

* * * * *